US012546116B1

(12) United States Patent
Bowman et al.

(10) Patent No.: US 12,546,116 B1
(45) Date of Patent: Feb. 10, 2026

(54) COMPOSITE STAIR TREAD

(71) Applicant: Gorilla Treads, LLC, Heber City, UT (US)

(72) Inventors: Christopher Bowman, Draper, UT (US); Corey Keller, Lehi, UT (US); Preston Ray Ward, Centerville, UT (US)

(73) Assignee: Gorilla Treads, LLC, Heber City, UT (US)

( * ) Notice: Subject to any disclaimer, the term of this patent is extended or adjusted under 35 U.S.C. 154(b) by 154 days.

(21) Appl. No.: 18/141,939

(22) Filed: May 1, 2023

Related U.S. Application Data

(60) Provisional application No. 63/337,395, filed on May 2, 2022.

(51) Int. Cl.
*E04F 11/104* (2006.01)

(52) U.S. Cl.
CPC ..... *E04F 11/104* (2013.01); *E04F 2011/1046* (2013.01)

(58) Field of Classification Search
CPC ..... E04F 11/104; E04F 11/16; E04F 11/163; E04F 11/166; E04F 11/17; E04F 11/175; E04F 15/02183
See application file for complete search history.

(56) References Cited

U.S. PATENT DOCUMENTS 4,285,177 A * 8/1981 Seegers ..... E04F 11/163 428/688
6,082,061 A * 7/2000 Ryan ..... B29C 70/72 52/630
2014/0363621 A1* 12/2014 Ngo ..... B27B 9/02 52/309.1
2016/0326747 A1* 11/2016 DeChristofaro .. E04F 15/02038
2020/0190826 A1* 6/2020 Busby ..... E04F 15/02005

FOREIGN PATENT DOCUMENTS

WO WO-2020008298 A1 * 1/2020 ..... B28B 11/0863

* cited by examiner

*Primary Examiner* — Theodore V Adamos
(74) *Attorney, Agent, or Firm* — Workman Nydegger

(57) ABSTRACT

A stair. The stair tread comprises a composite material. The composite material is formed into a grid of ribs and a top side coupled to the grid of ribs. The top side comprises a gutter slope design comprising sloped grooves, where the depth of the grooves at a first end is deeper than the depth of the grooves at a second end, with a gradual slope from the first end to the second end.

14 Claims, 8 Drawing Sheets

COMPOSITE STAIR TREAD

CROSS-REFERENCE TO RELATED APPLICATIONS

This application claims the benefit of and priority to U.S. Provisional Patent Application Ser. No. 63/337,395 filed on May 2, 2022 and entitled "Composite Stair Tread," and which application is expressly incorporated herein by reference in its entirety.

BACKGROUND

Background and Relevant Art

In building manufacturing, one of the fundamental components installed in virtually every building is stairs. Even when buildings include modern amenities such as elevators and escalators, they nonetheless include staircases.

Currently, industrial staircases are constructed from iron stringers and reinforced concrete and/or iron treads. As one might imagine, these stringers and treads tend to degrade over time. This can be manifest in accumulated rust, chipping and cracking of concrete, etc. Additionally, installation of such stair systems requires multiple construction workers and/or heavy equipment to move and place the heavy concrete treads. Further, any mistreatment of the treads while transporting to an install location can result in cracking and other damage. Further, existing concrete stair treads are not particularly environmentally friendly to manufacture. In particular, concrete production involves the use of caustic chemicals as well as large amounts of natural resources needed to construct the treads.

Thus, there is a need for industrial stair treads that are lightweight such that they can be transported by a single construction worker. Additionally, there is a need for industrial stair treads that are long-lasting and durable. Further, it would be useful if stair treads could be manufactured in an environmentally friendly fashion.

The subject matter claimed herein is not limited to embodiments that solve any disadvantages or that operate only in environments such as those described above. Rather, this background is only provided to illustrate one exemplary technology area where some embodiments described herein may be practiced.

BRIEF SUMMARY

One embodiment illustrated herein includes a stair tread comprising a composite material. The composite material is formed into a grid of ribs and a top side coupled to the grid of ribs. The top side comprises a gutter slope design comprising sloped grooves, where the depth of the grooves at a first end is deeper than the depth of the grooves at a second end, with a gradual slope from the first end to the second end.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

Additional features and advantages will be set forth in the description which follows, and in part will be obvious from the description, or may be learned by the practice of the teachings herein. Features and advantages of the invention may be realized and obtained by means of the instruments and combinations particularly pointed out in the appended claims. Features of the present invention will become more fully apparent from the following description and appended claims, or may be learned by the practice of the invention as set forth hereinafter.

BRIEF DESCRIPTION OF THE DRAWINGS

In order to describe the manner in which the above-recited and other advantages and features can be obtained, a more particular description of the subject matter briefly described above will be rendered by reference to specific embodiments which are illustrated in the appended drawings. Understanding that these drawings depict only typical embodiments and are not therefore to be considered to be limiting in scope, embodiments will be described and explained with additional specificity and detail through the use of the accompanying drawings in which.

DETAILED DESCRIPTION

Embodiments illustrated herein are directed to a tread and stringer system that can be used either in new construction or as a replacement for existing stair systems, and in particular a replacement for existing stair treads in those systems. In some of the examples illustrated herein, the stair treads are formed of a composite material using an injection molding process. In alternative embodiments, the stair treads are formed from recycled rubber.

Some embodiments include a gutter slope design is illustrated, where the stair treads pattern has sloped grooves. For example, the depth of the grooves at a first end is deeper than the depth of the grooves at a second end, with a gradual slope from the first end to the second end. This allows water to flow from the second end to the first end, where the water can be shed from the stair tread. This prevents water accumulation. In cold temperature environments, this can also prevent ice buildup on the stair treads in the stair tread patterns.

Some embodiments are formed as a unitary piece meaning that the injection molding process causes a of ribs and top, textured side to be molded together as a single unitary piece in a single molding process, rather than being formed as a separate grid and top piece that are then later fastened together.

Figure 1:
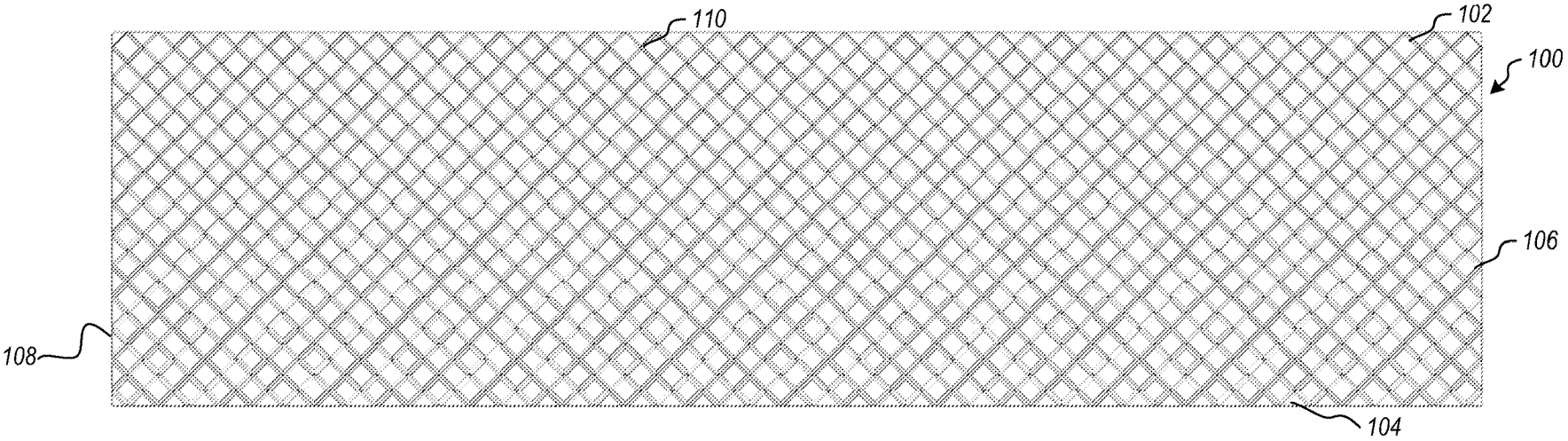
FIG. 1 illustrates a top plan view of a stair tread according to one embodiment of the invention.

Details are now illustrated. FIG. 1 illustrates a top plan view of a stair tread according to one embodiment of the invention. In this example, the stair tread 100 includes a front edge 102, a back edge 104, a right side 106, a left side 108, and a top side 110. The top side 110 includes grooves. The example illustrated in FIG. 1 shows a gutter slope design where the stair tread pattern has sloped grooves. For example, the depth of the grooves at back edge 104 is deeper than the depth of the grooves at the front edge 102, with a gradual slope from the back edge 104 to the front edge causing water to flow from the front edge 102 to the back edge 104. In this particular example, the stair tread 100 is 11 inches deep (i.e., from front edge 102 to back edge 104). The depth of the groove at the front edge 102 slopes to the back edge 104.

FIG. 1 illustrates that the grooves may be formed in a diamond shaped pattern.

Figure 2:
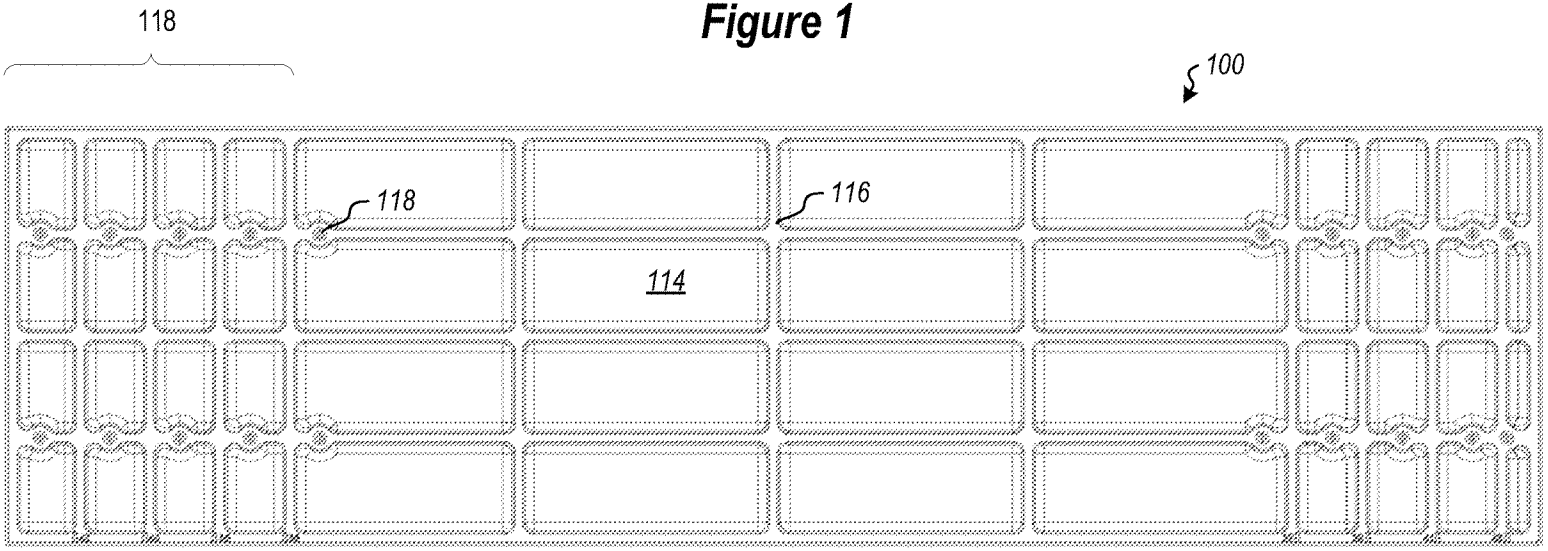
FIG. 2 illustrates a bottom view of a stair tread according to one embodiment of the invention.

FIG. 2 illustrates a bottom view of the stair tread 100 according to one embodiment of the invention, and illustrates a bottom side 114 of the stair tread 100. In this particular example, the stair tread 100 includes a grid 116 of ribs coupled to the top side 110. As noted above, in some embodiments, the grid 116 of ribs and the top side 110 are formed as a single unitary piece. For example, the grid 116 of ribs and the top side 110 may be formed in an injection molding process. Note that in some embodiments, the tread 100 may be molded where molding gates in the mold are proximate the center rib (at either the bottom side 114 or the top side 110) to reduce knit lines at the highest stress regions.

In the example illustrated in FIG. 2, a set 118 of cut lines are included in the design. The cut lines allow the tread 100 to be cut to size by marking appropriate places to cut the tread, such as at rib intersections. In some embodiment, the cut lines are spaced such that the tread 100 can be sized from 44 inches to 36 inches. The cut lines are in 1-inch increments. In some embodiments, the cut lines are marked with sizes to show where the tread 100 should be cut to form a tread of a particular size.

FIG. 2 further illustrates various screw bosses, e.g., screw boss 118, where screws, such as e.g., ⅜" diameter lag screws, can be used to fasten the tread 100 to a stringer. In the illustrated example, the screw bosses are formed where ribs intersect.

Figure 3:
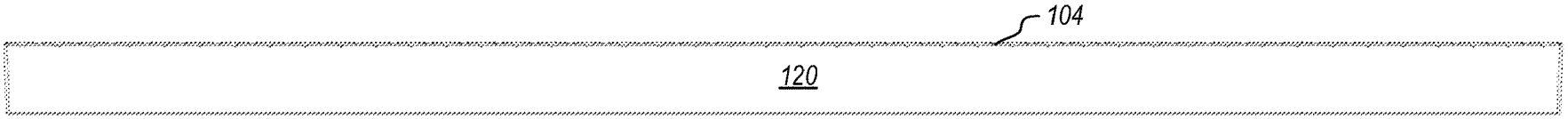
FIG. 3 illustrates a rear elevation view of a stair tread according to one embodiment of the invention.
Figure 4:
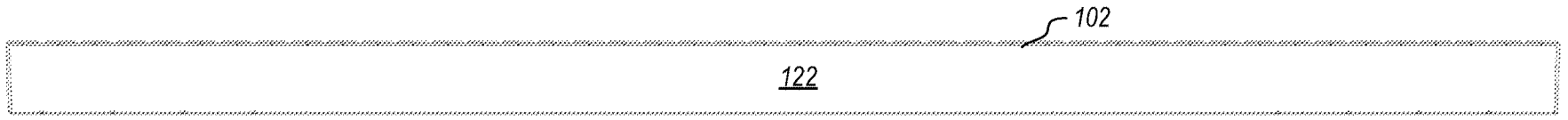
FIG. 4 illustrates a front elevation view of a stair tread according to one embodiment of the invention.
Figure 5:
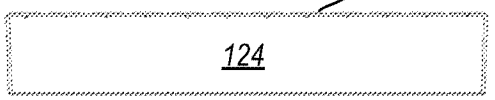
FIG. 5 illustrates a right elevation view of a stair tread according to one embodiment of the invention.
Figure 6:
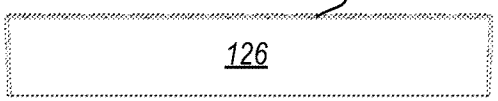
FIG. 6 illustrates a left elevation view of a stair tread according to one embodiment of the invention.

FIG. 3 illustrates a rear elevation view of the stair tread 100, showing a rear face 120; FIG. 4 illustrates a front elevation view of the stair tread 100 showing a front face 122; FIG. 5 illustrates a right elevation view of the stair tread 100 showing a right face 124; and FIG. 6 illustrates a left elevation view of the stair tread 100 showing a left face 126. Careful examination of these views further illustrates the sloping grooves discussed above.

Figure 7:
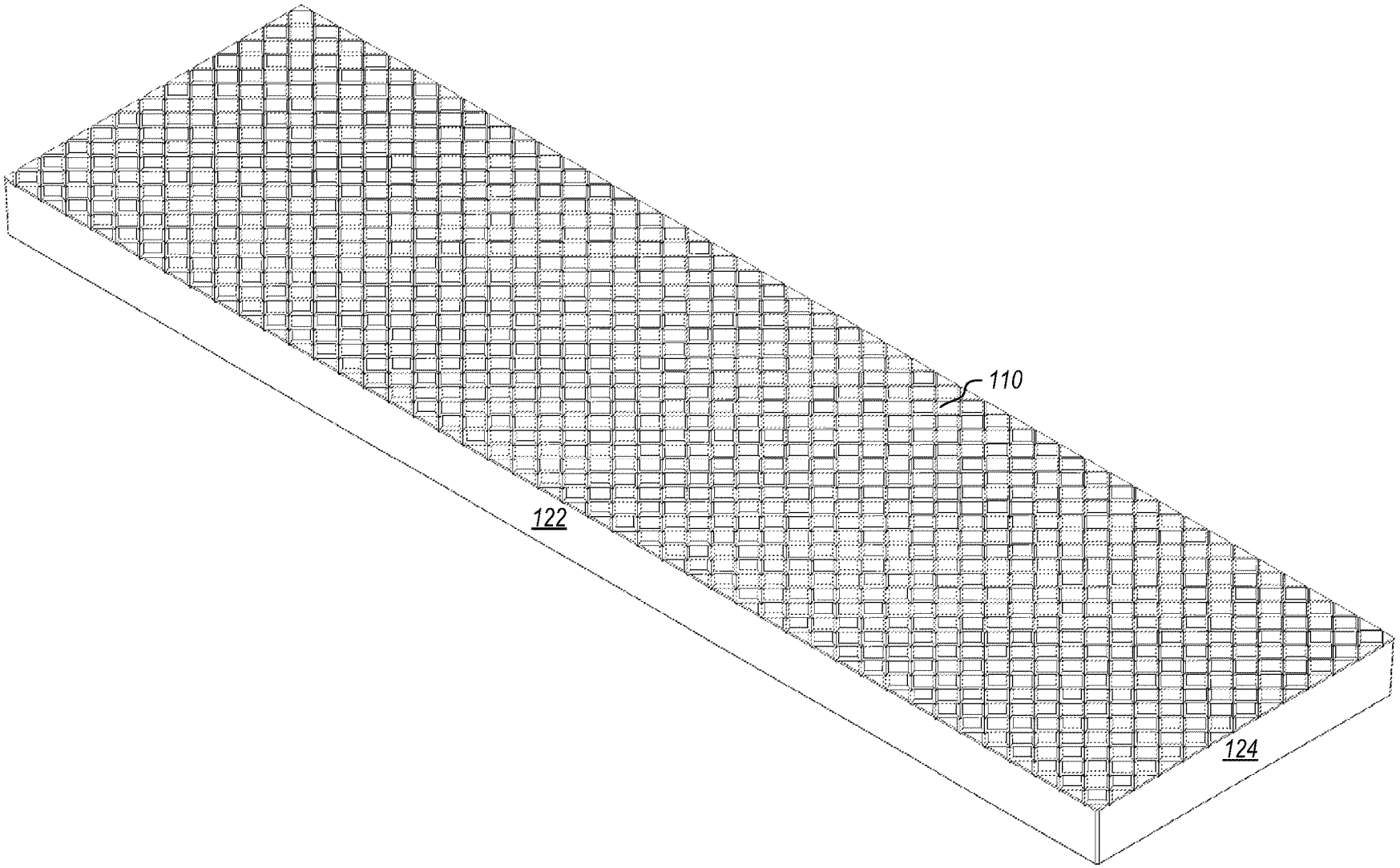
FIG. 7 illustrates a perspective top view of a stair tread according to one embodiment of the invention.
Figure 8:
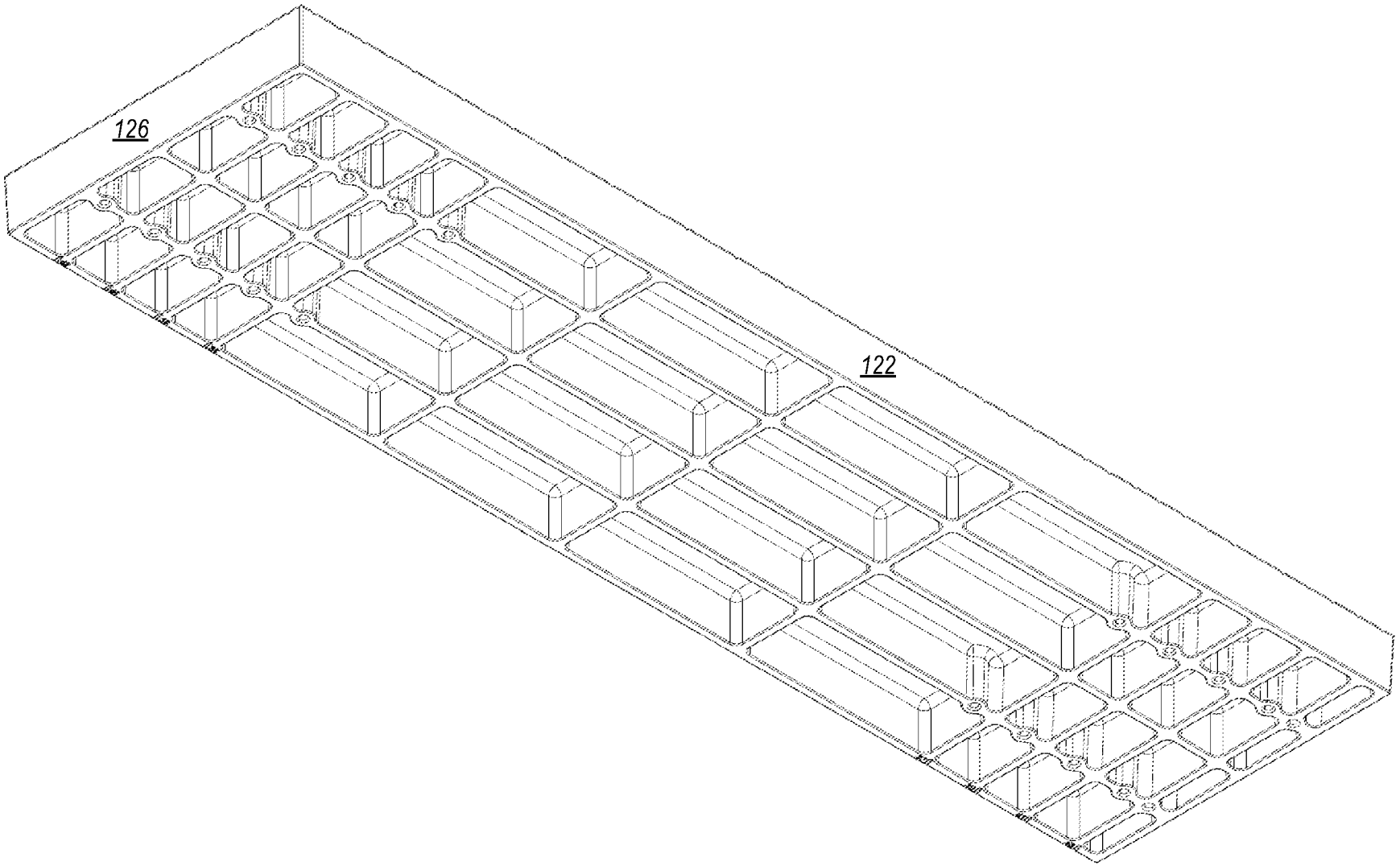
FIG. 8 illustrates a perspective bottom view of a stair tread according to one embodiment of the invention.

FIG. 7 illustrates a perspective top view of the stair tread 100 and FIG. 8 illustrates a perspective bottom view of the stair tread 100.

Figure 9:
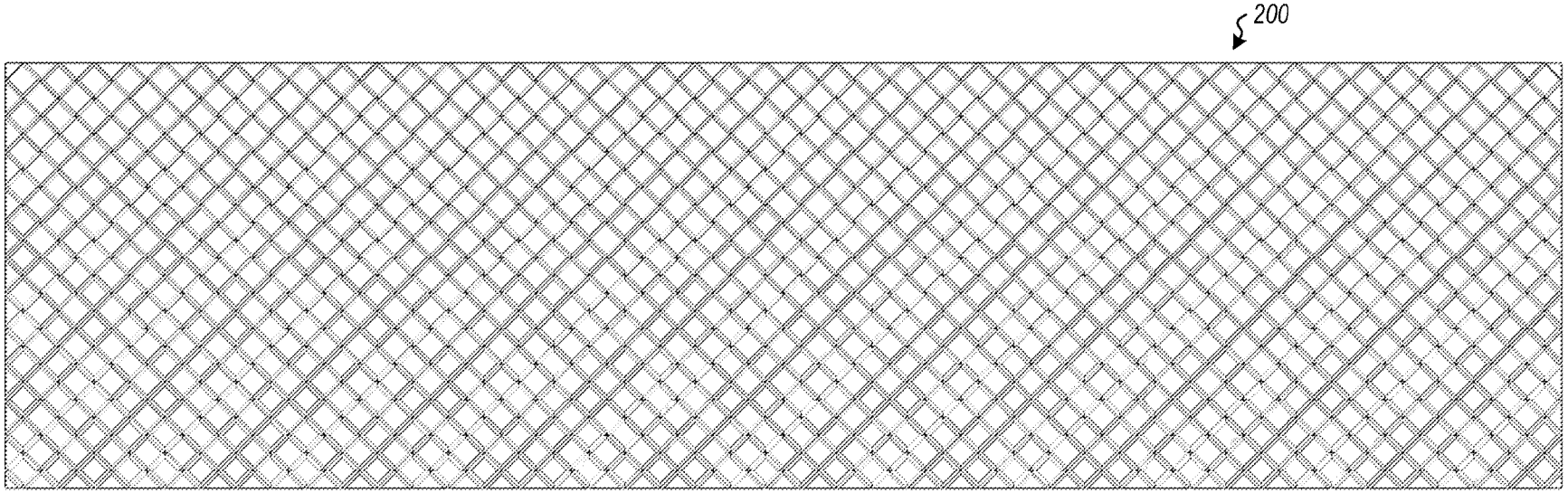
FIG. 9 illustrates a top plan view of a stair tread according to a second embodiment of the invention.
Figure 10:
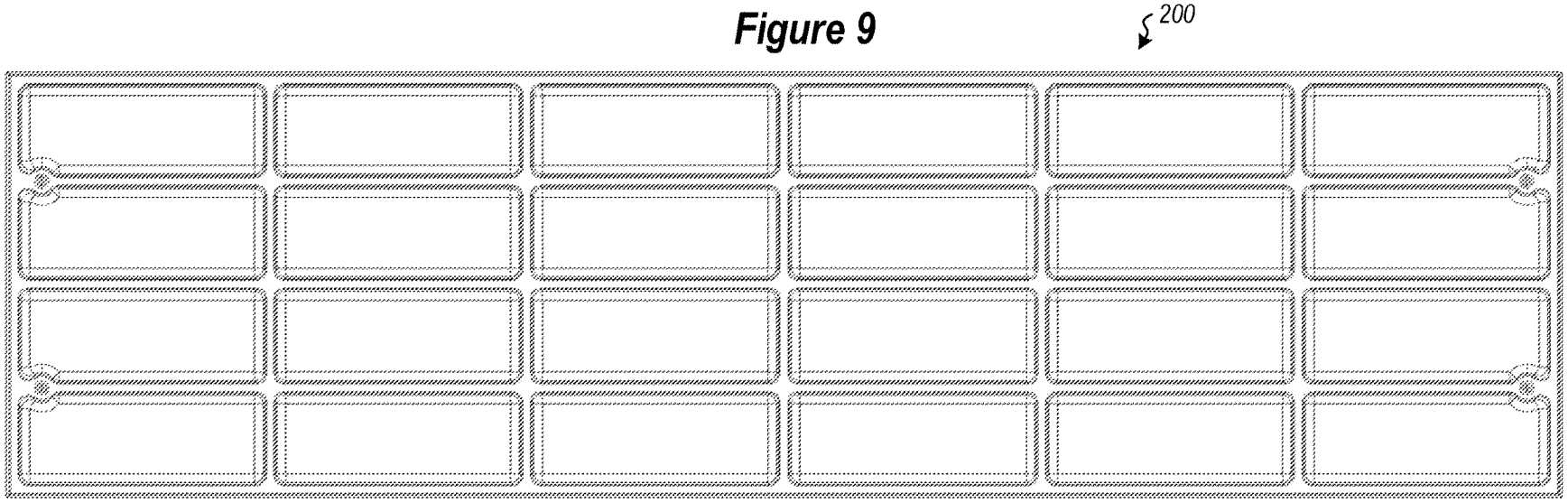
FIG. 10 illustrates a bottom view of a stair tread according to a second embodiment of the invention.
Figure 11:
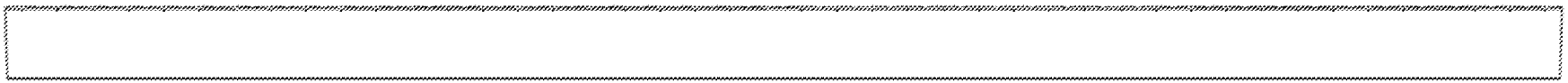
FIG. 11 illustrates a rear elevation view of a stair tread according to a second embodiment of the invention.
Figure 12:
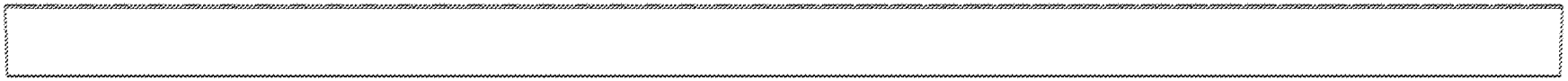
FIG. 12 illustrates a front elevation view of a stair tread according to a second embodiment of the invention.
Figure 13:
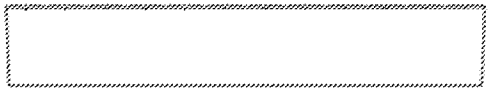
FIG. 13 illustrates a right elevation view of a stair tread according to a second embodiment of the invention.
Figure 14:
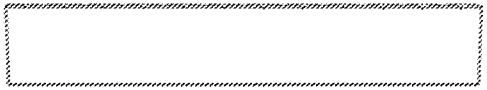
FIG. 14 illustrates a left elevation view of a stair tread according to a second embodiment of the invention.
Figure 15:
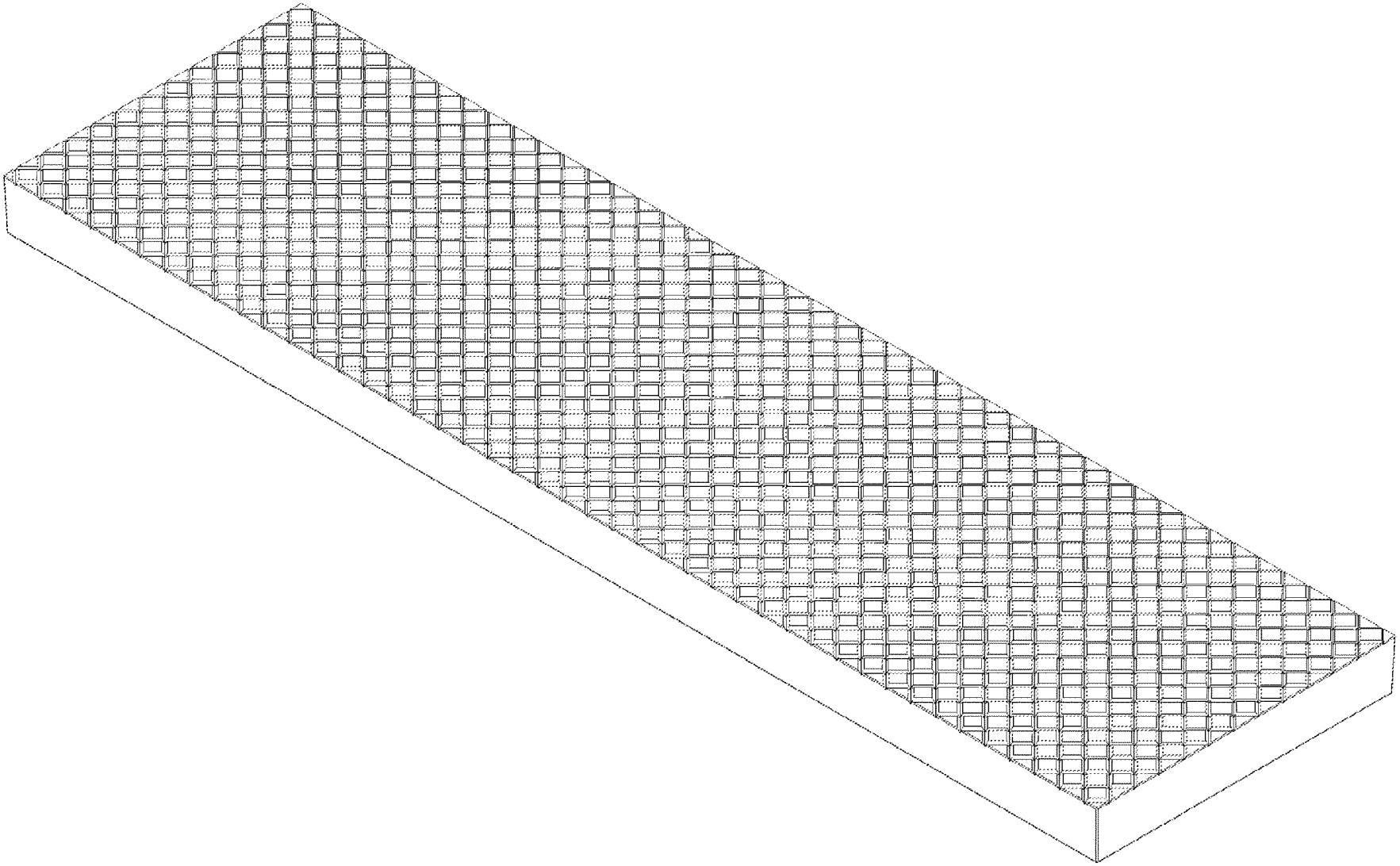
FIG. 15 illustrates a perspective top view of a stair tread according to a second embodiment of the invention.
Figure 16:
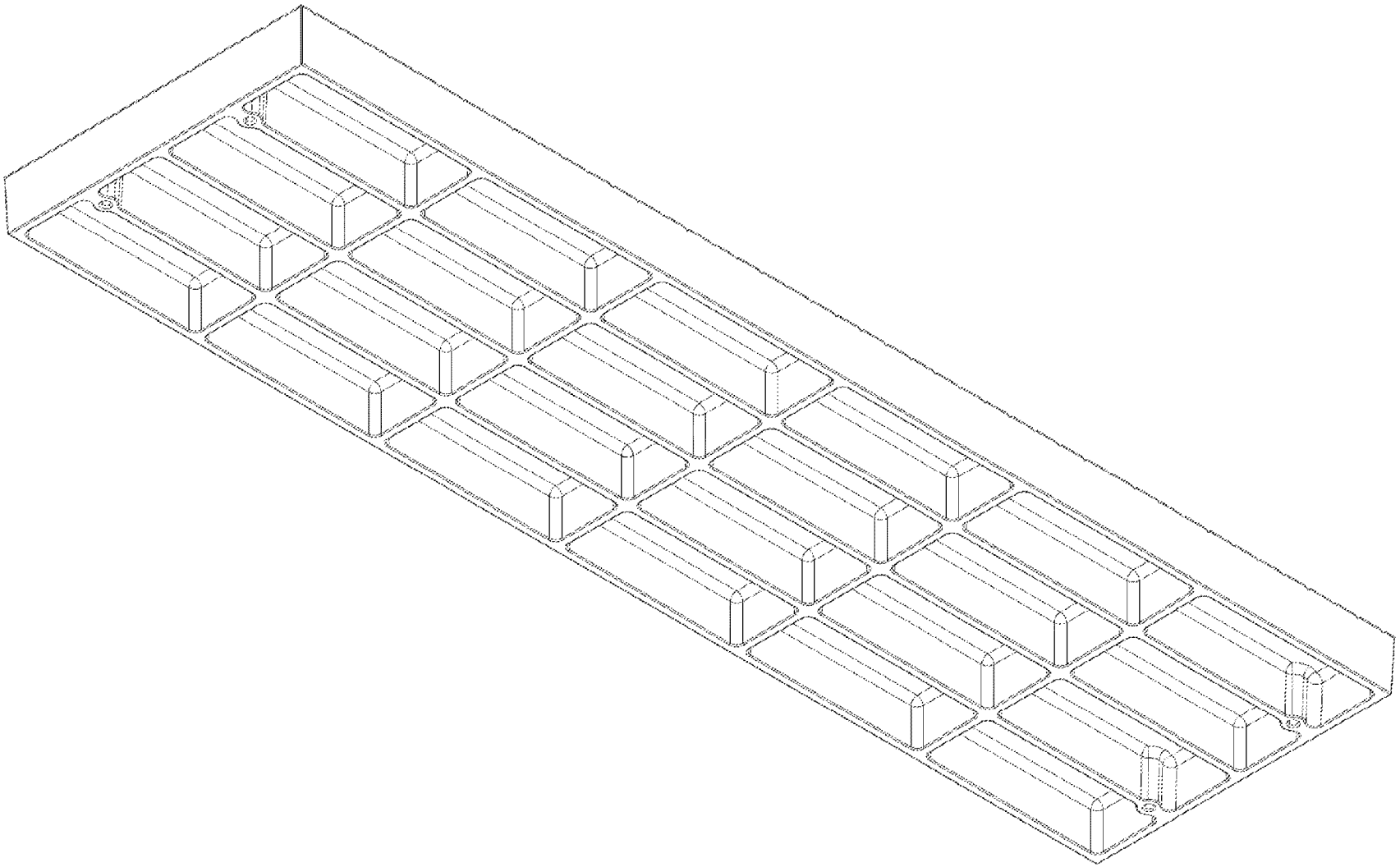
FIG. 16 illustrates a perspective bottom view of a stair tread according to a second embodiment of the invention.

FIGS. 9-16 illustrate various views similar to those of FIGS. 1-8, except for a stair tread 200 sized for a particular size, and thus not having the cut lines as shown above, and a single set of screw bosses as opposed to multiple sets of screw bosses. Thus, FIG. 9 illustrates a top plan view of a stair tread 200 according to a second embodiment of the invention. FIG. 10 illustrates a bottom view of the stair tread 200. according to a second embodiment of the invention. FIG. 11 illustrates a rear elevation view of the stair tread 200. FIG. 12 illustrates a front elevation view of the stair tread 200. FIG. 13 illustrates a right elevation view of the stair tread 200. FIG. 14 illustrates a left elevation view of the stair tread 200. FIG. 15 illustrates a perspective top view of the stair tread 200. FIG. 16 illustrates a perspective bottom view of the stair tread 200.

In some embodiments, copper wiring, heat cable, or even fluid carrying tubes can be embedded into the stair tread. This allows for embodiments to be implemented to heat the stair tread to prevent water and ice buildup. For example, resistive heating elements embedded into the stair tread can be coupled to an electrical source to warm the stair tread to prevent ice from forming. In an alternative embodiment, a boiler can produce heated fluids which can be pumped through embedded tubes in the stair tread to prevent ice buildup on the stair tread.

In some embodiments, the stair tread pattern (i.e., the top side) is sandblasted to create a course surface with small protrusions on the stair tread. The sandblasting is performed so as to cause the protrusions to be of a size and character, and with sufficient spacing with respect to each other to break water surface tension to further inhibit the accumulation of water by allowing the water to flow to the grooves and to flow off of the stair tread.

In some embodiments, the ribs have rebar. In these embodiments, metal held in place in a mold and plastic injected into the mold, or rubber formed around the metal.

In some embodiments, a bracket system may be implemented with pegs formed into the ribs, where the pegs can then be placed into stringers.

In some embodiments, the stair treads are manufactured from a certain percentage of recycled material. For example, the stair treads may be manufactured using recycled rubber or other materials.

In some embodiments, the treads may be manufactured from RTP 205.3 RC HS having Nylon 6/6 (PA) with 33% Glass Fiber. Available from RTP Company of Winona, MN. Alternatively, the treads may be manufactured from RTP 205 FR UV having Nylon 6/6 (PA) with Glass Fiber, also available from RTP Company of Winona, MN. This particular material is flame retardant and UV stabilized. Other alternative materials may be used alternatively or additionally. In particular, materials can be selected to comply with particular building standards to meet requirements for UV protection, fire protection, strength, etc.

The present invention may be embodied in other specific forms without departing from its characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A stair tread comprising:

a composite material, wherein the composite material is formed into:

a grid of ribs;

a top side coupled to the grid of ribs, wherein the top side comprises a gutter slope design comprising sloped grooves, where the depth of the grooves at a first end is deeper than the depth of the grooves at a second end, with a gradual slope from the first end to the second end; and cut lines provided on respective ribs in the grid of ribs extending parallel to the drainage direction of the tread, wherein the cut lines are spaced at 1-inch increments and are configured to assist in cutting the tread to size.

2. The stair tread of claim 1, wherein the top side is sandblasted.

3. The stair tread of claim 1, wherein the grid of ribs and the top side are formed as a single unitary piece.

4. The stair tread of claim 1, further comprising screw bosses formed in ribs in the grid of ribs.

5. The stair tread of claim 1, wherein the composite material comprises recycled rubber.

6. A stair tread comprising:

a composite material, wherein the composite material is formed into:

a grid of ribs;

a top side coupled to the grid of ribs, wherein the top side comprises a gutter slope design comprising sloped grooves, where the depth of the grooves at a first end is deeper than the depth of the grooves at a second end, with a gradual slope from the first end to the second end; and screw bosses being on respective ribs in the grid of ribs extending perpendicular to the drainage direction of the tread.

7. The stair tread of claim 6, wherein the top side is sandblasted.

8. The stair tread of claim 6, wherein the grid of ribs and the top side are formed as a single unitary piece.

9. The stair tread of claim 6, further comprising cut lines to show a tread can be cut.

10. The stair tread of claim 6, wherein the composite material comprises recycled rubber.

11. A stair tread comprising:

a composite material, wherein the composite material is formed into:

a grid of ribs;

a top side coupled to the grid of ribs, wherein the top side comprises a gutter slope design comprising sloped grooves, where the depth of the grooves at a first end is deeper than the depth of the grooves at a second end, with a gradual slope from the first end to the second end;

cut lines spaced at 1-inch increments; and screw bosses being on respective ribs in the grid of ribs extending perpendicular to the drainage direction of the tread.

12. The stair tread of claim 11, wherein the top side is sandblasted.

13. The stair tread of claim 11, wherein the grid of ribs and the top side are formed as a single unitary piece.

14. The stair tread of claim 11, wherein the composite material comprises recycled rubber.

* * * * *